US006721432B1

(12) United States Patent
Yamamoto

(10) Patent No.: US 6,721,432 B1
(45) Date of Patent: Apr. 13, 2004

(54) MICROPHONE AND VIDEO CAMERA

(75) Inventor: Takashi Yamamoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 34 days.

(21) Appl. No.: 10/089,379

(22) PCT Filed: Sep. 29, 2000

(86) PCT No.: PCT/JP00/06811

§ 371 (c)(1),
(2), (4) Date: Mar. 29, 2002

(87) PCT Pub. No.: WO01/24573

PCT Pub. Date: Apr. 5, 2001

(30) Foreign Application Priority Data

Sep. 30, 1999 (JP) ..... 11-279069

(51) Int. Cl.[7] ..... H04R 11/04

(52) U.S. Cl. ..... 381/355; 381/356; 381/361; 381/368; 381/360

(58) Field of Search ..... 381/355, 358, 381/356, 359, 361, 365, 368, 360; 439/95, 382, 383, 384

(56) References Cited

U.S. PATENT DOCUMENTS 5,233,667 A * 8/1993 Lee ..... 381/365

5,303,304 A * 4/1994 Lee ..... 381/26

FOREIGN PATENT DOCUMENTS

JP 03-026474 4/1996

OTHER PUBLICATIONS

Microfilm of the Specification and Drawings Annexed to the Request of Japanese Utility Model Application No. 145485/1988, (Laid–Open No. 66095/1990), May 18, 1990.

Microfilm of the Specification and Drawings Annexed to the Request of the Japanese Utility Model Application No. 51851/1982, (Laid–Open No. 155186/1983), Oct. 17, 1983.

* cited by examiner

*Primary Examiner*—Curtis Kuntz
*Assistant Examiner*—Tuân D Nguyêñ
(74) *Attorney, Agent, or Firm*—McDermott, Will & Emery

(57) ABSTRACT

An intermediate connector (14) is provided between a microphone unit (2) and a cylindrical housing (4). The connector (14) electrically connects the grounding part of the microphone unit (2) and the cylindrical housing (4) substantially by the shortest path while blocking mechanical vibrations. As a result, undesired high-frequency noises attributed to surrounding strong electric field are removed.

16 Claims, 7 Drawing Sheets

MICROPHONE AND VIDEO CAMERA

FIELD OF THE INVENTION

The invention relates to a microphone used in a video camera etc.

BACKGROUND ART

There has conventionally been available such a directional microphone used in a video camera etc. as follows. That is, this microphone includes a capacitor microphone unit and an amplification circuit board housed and disposed in a cylindrical housing having a structure enhancing directivity and also houses and disposes this cylindrical housing in an outer cylinder. Between the cylindrical housing and the capacitor microphone unit is sandwiched vibration preventing rubber. Likewise, between the cylindrical housing and the outer cylinder is also disposed vibration preventing rubber. In such a configuration, an audio signal converted into an electric signal by the capacitor microphone unit is amplified by the amplification circuit board and then issued to the outside. It should be noted that the cylindrical housing houses a battery therein in some cases.

This prior art microphone, however, suffers from a problem of occurrence of an interference sound caused by an electromagnetic wave. The interference sound here refers to the following. That is, it refers to a noise sound superimposed on a recorded speech sound which occurs due to a high-frequency component contained in an external electromagnetic wave when the speech sound is recorded by a microphone.

With recent prevalence of portable telephones, there have been increasing such cases that many unspecified persons including reporters using a microphone use those portable telephones in communication at a recording site requiring a microphone. In particular, if a reporter uses his portable telephone while recording a variety of speech sounds, he would use his microphone and portable telephone in such a state where they are very close to each other. Such a use situation of a microphone may occur on an every-day basis in the future too when a news site is reported using a video camera etc. having a built-in microphone.

Although an influence of an electric field generated by a portable telephone reaches relatively short, it is known that in its vicinity (within a few to few tens of centimeters therefrom), that field has a very high strength of a few tens of volts/meter, which is a few tens of thousands of times as much as that generated over the cities by a commercial radio wave.

If a microphone and a portable telephone are used as being very close to each other, an electromagnetic wave generated by the portable telephone has a remarkable influence on the microphone, so that an interference sound is mixed into an audio signal. This is described specifically as follows.

A microphone can be considered to be an operation circuit of an FET transistor the gate of which serves as a diaphragm of a capacitor microphone unit. In the operation circuit of such an FET transistor, a vibration generated by a sound pressure of speech sound is captured as a potential induced across an electret film which constitutes the diaphragm. Accordingly, in the microphone, a sound-pressure deviation is captured as a voltage deviation, which is in turn taken in as a change in voltage input to the gate of the FET transistor. The change in voltage input thus taken in is used as an audio signal input to thereby operate the microphone.

If a high-frequency strong electric field occurs near a microphone unit having such characteristics, a nonlinear distortion occurs in an input/output circuit or other electric circuits of the electret film or FET transistors, so that an envelope detected-wave output of a frequency-modulated, amplitude-modulated, and digital-modulated high-frequency signals appears in an audio band. Further, a similar detected-wave output appears also at a subsequent-stage amplification circuit board. Such a detected-wave output gives rise to various high-frequency interference sounds in the audio signal.

The recent prevalence of portable telephones has been shifting a service frequency band toward a higher frequency side (e.g., 1.5 GHz), so that presently an influence of electromagnetic waves on such a microphone is becoming more and more remarkable. Accordingly, there is desired such a microphone that is not easily influenced by electromagnetic waves.

Also, to prevent beforehand any disturbance due to malfunction etc. of a variety of electronic apparatuses caused by an electromagnetic wave, many counties have laws ahd regulations of the electrbmagnetic-wave resistance of such electronic equipment. One example is CE (Conformite Eoropeenne) in Europe. Further, with prevalence of high-electromagnetic-wave generators used by individuals represented by a portable telephone, many countries are trying to prevent beforehand the future-expected disturbance caused by an electromagnetic wave by further tightening those laws and regulations so that only such products that have a higher electromagnetic-wave resistance may be allowed to circulate in the world markets. In view of such a status quo, the microphone is also desired to have an even higher electromagnetic-wave resistance.

To solve the above-mentioned problems, the prior-art microphone is also provided with a grounding path for connecting a grounding part thereof to the ground. This grounding path, however, is comprised of a lead wire for interconnecting the microphone unit and the amplification circuit board, a grounding wiring line in the amplification circuit board, and a lead wire for interconnecting the amplification circuit board and a microphone cable, so that it cannot be the shortest path effective enough to remove an interference sound caused by a high-frequency electric field.

A In view of the above, it is an object of the invention to provide a microphone unit which can effectively remove an interference sound caused by a high-frequency electric field.

SUMMARY OF THE INVENTION

A microphone or a video camera according to the invention includes a microphone unit, a cylindrical housing made of a conductor for housing the microphone unit, and an intermediate connector which electrically connects a grounding part of the microphone unit to the cylindrical housing along essentially the shortest path while blocking mechanical vibrations. In this configuration, it operates as follows.

Even if an electric field induced by an electromagnetic wave present around the microphone is formed in the cylindrical housing to correspondingly cause such a high-frequency signal to occur in the microphone unit that contains a modified signal which gives an interference sound to the microphone, the high-frequency signal is led through the intermediate connector to the cylindrical housing along essentially the shortest distance. By grounding the cylindrical housing beforehand, therefore, such a high-frequency signal occurring at the microphone unit can be securely discharged to the ground through the cylindrical housing. Moreover, the cylindrical housing, which is a conductor having a simple construction and also which has a vibration preventing mechanism between itself and an outer cylinder, serves to connect the microphone unit to the ground potential therethrough along essentially the shortest path not longer than necessary. This configuration enables to securely decrease the interference sound caused by such a high-frequency signal as mentioned above.

It should be noted that the cylindrical housing has a simple construction and so is liable to be exposed to the outside at part of a peripheral surface or end thereof, so that it can be grounded relatively easily.

Also, in the improved microphone of the invention, the intermediate connector is made of an elastic short-hair-shaped conducting member, which itself is protruded from either one of the microphone unit and the cylindrical housing as having its tip abutted against the other. In this configuration, the following is possible.

The short-hair-shaped conducting member can give a sufficient function required on the intermediate connector of electrically interconnecting the two while blocking the mechanical vibrations and also can be mounted relatively simply.

Also, in the improved microphone of the invention, the intermediate connector is made of an elongated conducting slice which is twist-reformed. This has the following effects.

The twist-reformed elongated conducting slice can give a sufficient function required on the intermediate connector of electrically interconnecting the two while blocking the mechanical vibrations and also can be mounted relatively easily.

Also, in the improved microphone of the invention, the amplification circuit board for amplifying an output signal of the microphone unit is housed in the cylindrical housing and also has its grounding part electrically connected to the cylindrical housing along essentially the shortest distance. This has the following effects.

It is possible to discharge through the cylindrical housing to the ground such a high-frequency signal which may possibly occur, due to an electromagnetic wave present around the microphone, in the amplification circuit board that contains a modified signal which may give an interference sound to the microphone.

Also, the improved microphone of the invention further includes a lid made of a conductor which seals the end of the cylindrical housing and also electrically connected thereto and a microphone cable which passes through the lid from the inside to the outside of the cylindrical housing for providing an output signal of the microphone to the outside in such a configuration that a shield layer of the microphone cable is electrically connected to the lid. This has the following effects.

The cylindrical housing can be electrically connected through the lid to the shield layer of the microphone cable, thus connecting the cylindrical housing to the ground potential easily and along the shortest distance.

Also, the improved microphone of the invention further includes an outer cylinder made of a conductor for surrounding the peripheral surface of the cylindrical housing and another intermediate connector for electrically interconnecting the cylindrical housing and the outer cylinder with essentially the shortest distance while blocking the mechanical vibrations. This has the following effects.

If an electric field is formed, due to an electromagnetic wave present around the microphone, at a gap between the cylindrical housing and the outer cylinder, such a high-frequency signal corresponding to the electric field may occur on the microphone unit, the cylindrical housing or the outer cylinder that contains. a modulated signal giving an interference sound to the microphone. Thus generated high-frequency signal, however, passes through the former intermediate connector and the another intermediate connector to the cylindrical housing or the outer cylinder. Accordingly, by connecting the cylindrical housing or the outer cylinder to the ground potential, the high-frequency signal can be securely decreased through the cylindrical housing or the outer cylinder to the ground potential. Moreover, the cylindrical housing or the outer cylinder, which is made of a conductor having a simple construction, is used to ground the microphone therethrough, thus enabling essentially minimizing a path in length not longer than necessary between the microphone unit and the ground potential. This also contributes to mitigating of the high-frequency signal. Also, the outer cylinder, like the cylindrical housing, is simple in construction and has often part of the peripheral surface thereof exposed to the outside, thus enabling connecting the outer cylinder to the ground potential relatively easily.

Also, in the improved microphone of the invention, the another intermediate connector is made of an elastic short-hair-shaped conducting member, which is protruded from either one of the cylindrical housing and the outer cylinder as having its tip as abutted against the other. This has the following effects.

The short-hair-shaped conducting member can sufficiently have a function required on the another intermediate connector of electrically interconnecting the two with essentially the shortest distance while blocking the mechanical vibrations and also can be mounted relatively easily.

Also, in the improved microphone of the invention, the another intermediate connector is made of a twist-reformed elongated conducting slice. This has the following effects.

This twist-reformed elongated conducting slice can sufficiently have a function required on the another intermediate connector of electrically interconnecting the two while blocking the mechanical vibrations and also can be mounted relatively easily.

Also, in the improved microphone of the invention, the intermediate connector and the another intermediate connector are disposed at the same position along the axis of the cylindrical housing. This has the following effects.

It is possible to interconnect the microphone unit, the cylindrical housing, and the outer cylinder to the ground potential with the shortest distance without a detour. This enables to securely decrease a high-frequency signal, (which contains a modulated signal giving an interference sound to the microphone) which occurs on the microphone unit, the cylindrical housing or the outer cylinder, to the ground potential.

Also, in the improved microphone of the invention, the further intermediate connector is disposed at. such a position in the microphone that is subject to cavity resonance. This has the following effects. A high-frequency signal caused by cavity resonance can be securely decreased to the ground potential. It should be noted that cavity resonance referred to the above-mentioned aspects is supposed to have a frequency from a few tens of mega-hertz to a few giga-hertz.

In addition to the above-mentioned features, preferably the microphone of the invention further includes a supporting member for supporting the microphone unit in the cylindrical housing while blocking mechanical vibrations. This has the following effects.

Although the microphone having such a supporting member can prevent the occurrence of an interference sound caused by the mechanical vibrations occurring at the cylindrical housing, it is difficult construction-wise to electrically interconnect the microphone unit and the cylindrical housing via the supporting member. To guard against this, the supporting member can be provided together with the intermediate connector to thereby achieve supporting and fixing, of the microphone unit in the cylindrical housing and electrical interconnection therebetween, thus preventing the interference sound from occurring.

Also, preferably the microphone of the invention further includes another supporting member for supporting the cylindrical housing in the outer cylinder while blocking mechanical vibrations. This has the following effects.

Although the microphone having such a supporting member can prevent the occurrence of an interference sound caused by mechanical vibrations occurring at the outer cylinder, it is difficult construction-wise to electrically interconnect the microphone unit and the outer cylinder via another supporting member. To guard against this, the another supporting member can be provided together with another intermediate connector to thereby achieve supporting and fixing of the cylindrical housing in the outer cylinder and electrical interconnection between the microphone unit and the outer cylinder, thus preventing the interference sound from occurring.

Also, in the microphone of the invention, preferably the another intermediate connector is uniformly disposed at the gap between the cylindrical housing and the outer cylinder. This has the following effects.

A path for connecting the cylindrical housing and the outer cylinder to the ground potential with essentially the shortest distance without a detour can be naturally formed by the another intermediate connector uniformly disposed at the gap. This enables to securely decrease to the ground potential a high-frequency signal (which contains a modulated signal giving an interference sound to the microphone) occurring at the microphone unit, the cylindrical housing, or the outer cylinder.

Also, preferably the microphone of the invention includes a lid made of a conductor for sealing an end of the outer cylinder as electrically connected thereto and a microphone cable passing through the lid from an inside to an outside of the outer cylinder to thereby lead an output signal of the microphone to the outside in order to electrically interconnect a shield layer of the microphone cable and the lid. This has the following effects.

The cylindrical housing can be electrically connected through the lid to the shield layer of the microphone cable to thereby connect the outer cylinder to the ground potential easily and with the shortest distance.

BEST MODE OF CARRYING OUT THE INVENTION

The following will describe in detail a best embodiment of the invention with reference to the drawings.

Figure 1:
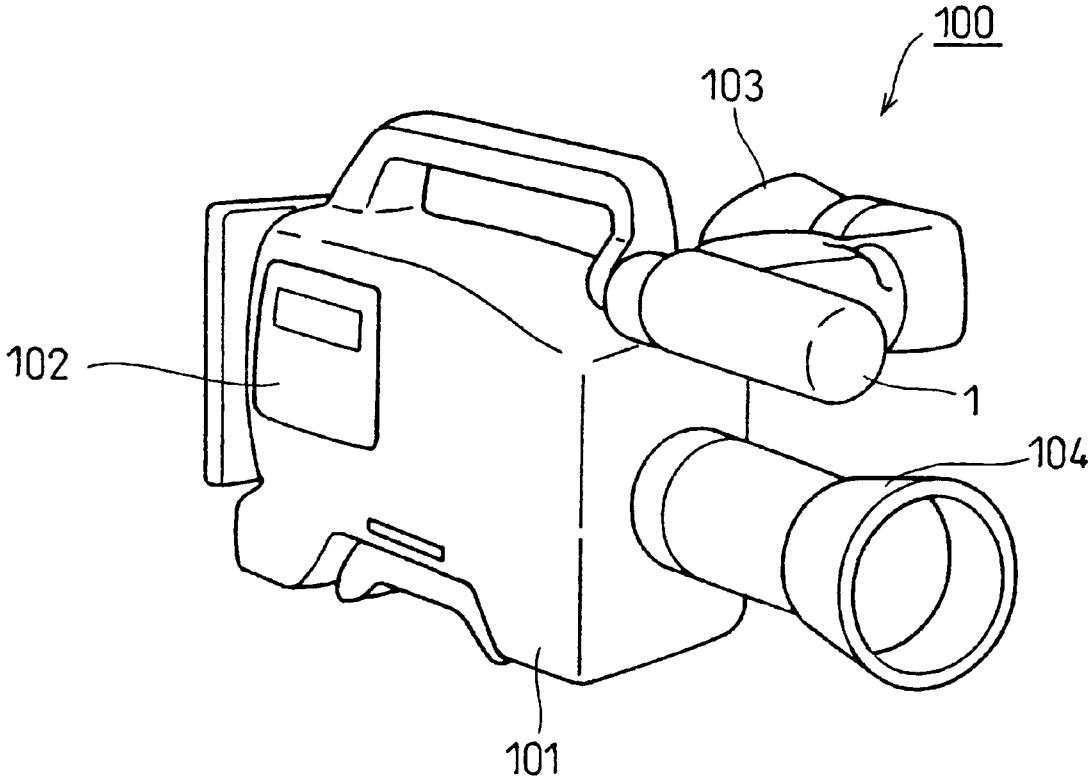
FIG. 1 is a perspective view for showing a schematic configuration of a video camera having therein a microphone related to a best embodiment of the invention.
Figure 2:
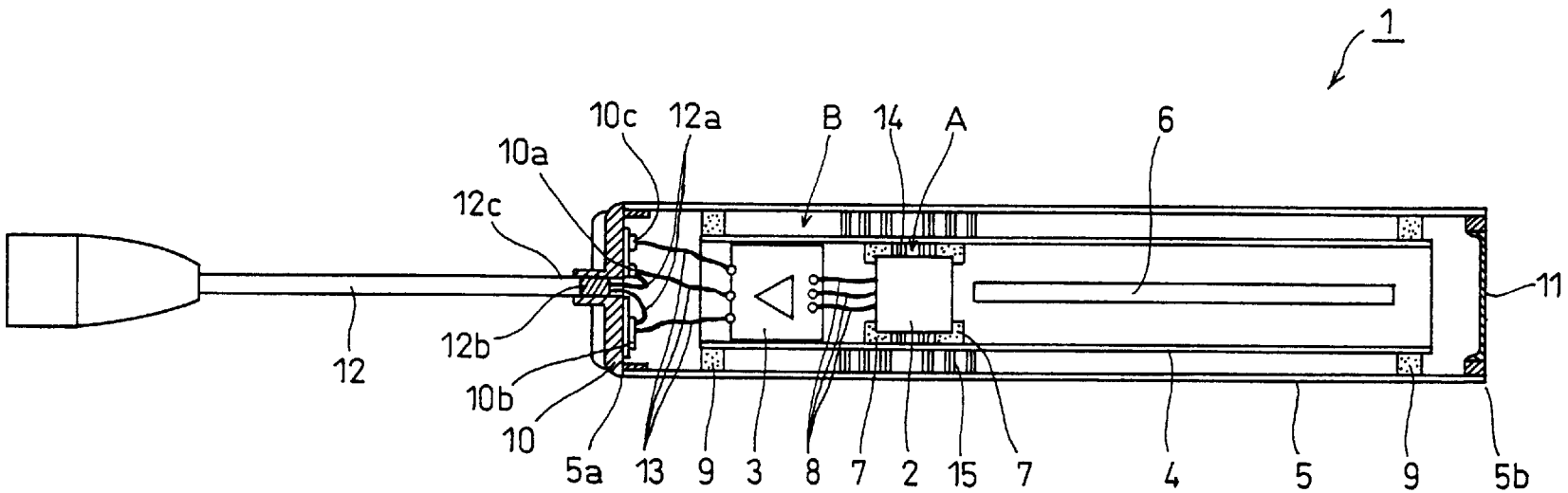
FIG. 2 is a cross-sectional view for showing a configuration of the microphone related to the embodiment.

FIG. 1 is a schematic diagram for showing a configuration of a video camera which a microphone related to the best embodiment of the invention is built in and FIG. 2 is a cross-sectional view for showing a configuration of the microphone. Although this embodiment of the invention exemplifies such a microphone that is built in the video camera, the invention is of course applicable to any other types of microphones.

This video camera 100 includes a recording/reproducing section 102 provided on a body 101, a view finder section 103 provided on a side of the body 101, a lens section 104 provided at a tip of the body 101, and a microphone 1 provided on the body 101 toward its tip.

As shown in FIG. 2, the microphone 1, which is of a capacitor type, is comprised of a capacitor microphone unit (hereinafter called a microphone unit) 2, an amplification circuit board 3, a cylindrical housing 4, and an outer cylinder 5. The cylindrical housing 4 and the outer cylinder 5 are made of a conductor such as metal.

The cylindrical housing 4 is cylindrical-shaped and has such a plurality of slits 6 formed in its peripheral surface along the axis that serves to give directivity to sound collection by the microphone 2. Note here that the cylindrical housing 4 may be polygonal in shape. Also note that only one slit 6 is shown in the cross-sectional view of FIG. 2.

The microphone unit 2 and the amplification circuit board 3 are housed and disposed in the cylindrical housing 4. The amplification circuit board 3 is disposed on the side of one end of the cylindrical housing 4. The microphone unit 2 is disposed inner side than the amplification circuit board 3 2, along the axis of the cylindrical housing 4. Specifically, the microphone unit 2 is supported and fixed on an inner peripheral surface of the cylindrical housing 4 with vibration preventing rubber 7 therebetween, which serves to block mechanical vibrations. A gap A is formed between the microphone unit 2 and the cylindrical housing 4 because they have the vibration preventing rubber 7 therebetween. An output terminal (not shown) of the microphone unit 2 and a ground terminal (not shown) are connected to corresponding input terminals (not shown) of amplification circuit board 3 through a lead wire 8.

The outer cylinder 5 is a cylinder having a somewhat larger diameter than the cylindrical housing 4 and has such a plurality of slits, not shown, formed in its peripheral surface along the periphery that serves to give directivity to sound collection by the microphone 1. Note here that the outer cylinder 5 may be polygonal in shape. The cylindrical housing 4 is housed in the outer cylinder 5 as disposed coaxially therewith. The cylindrical housing 4 is supported and fixed on the inner peripheral surface of the outer cylinder 5 in a state where the mechanical vibrations are blocked through vibration preventing rubber 9. Between the cylindrical housing 4 and the outer cylinder 5 is disposed vibration preventing rubber 9 to thereby form a gap B. The outer cylinder 5 has a somewhat longer axial dimension than the cylindrical housing 4, so that the cylindrical housing 4 is disposed in such a state that its ends are positioned on the inner sides of the outer cylinder 5.

An end 5*a*, which is one of the two ends of the outer cylinder 5 and at which the amplification circuit board 3 is positioned is sealed by a lid 10 made of a conductor such as metal. The other end 5*b* of the outer cylinder 5 is sealed by dust-proof mesh 11. The outer cylinder 5 and the lid 10 are directly connected with each other and so interconnected electrically.

At the radial center of the lid 10 is inserted and fixed one end of a microphone cable 12 for providing an output signal of the microphone 1 to the outside. On the inner surface of the lid 10 are provided relay terminals 10*a*, 10*b*, and 10*c*. The relay terminals 10*a* and 10*b* serve to relay an output signal of the amplification circuit board 3 to a conductor wire 12*a* of the microphone cable 12. Although not shown, the relay terminals 10*a* and 10*b* are provided in such a state that they are electrically insulated from the lid 10. To the relay terminals 10*a* and 10*b* is electrically connected an output terminal (not shown) of the amplification circuit board 3 via a lead wire 13. Further, the conductor wire 12*a* of the microphone cable 12 is electrically connected to the relay terminals 10*a* and 10*b*. In such a configuration, the output terminal of the amplification circuit board 3 and the conductor wire 12*a* of the microphone cable 12 are electrically interconnected through the relay terminals 10*a* and 10*b*.

Although not shown, the relay terminal 10*c* is provided on the lid 10 in a state that it is electrically connected thereto. The relay terminal 10*c* serves to relay a grounding part (not shown) of the amplification circuit board 3 to a shield layer 12*b* of the microphone cable 12. To the relay terminal 10*c* is electrically connected the grounding part (not shown) of the amplification circuit board 3 via the lead wire 13. Further, at en end of the microphone cable 12. on the side of the lid, an insulation housing 12*c* thereof is peeled off to expose the shield layer 12*b*, so that when the microphone cable 12 passes through the lid 10, its shield layer 12*b* comes in contact with the lid 10 and is electrically connected therewith. It should be noted that to secure electrical connected between the shield layer 12*b* and the lid 10, an intermediary terminal, not shown, may be inserted therebetween. In such a configuration, the grounding part of the amplification circuit board 3 is electrically connected to the shield layer 12*b* of the microphone cable 12 via the lid 10 and the relay terminal 10*c*. With this, when the microphone cable 12 is connected to a connection member (not shown) of the microphone 1, the shield layer 12*b* is connected to the ground potential of the connection. member. Thus, the grounding part of the amplification circuit board 3 is connected to the ground potential through the relay terminal 10*c* of the lid 10 and the shield layer 12*b* of the microphone cable 12.

The following will describe a configuration which features this microphone 1. In this microphone 1, an intermediate connector 14 is provided around the peripheral surface of the microphone unit 2. The intermediate connector 14 is made of a conductor such as metal that has a sufficiently low electrical resistance of a few tens of ohms (Ω). Specifically, the intermediate connector 14 is made of a plurality of short-hair-shaped members having conductivity and elasticity which is implanted in the peripheral surface of the microphone unit 2. More specifically, for example, the intermediate connector 14 is comprised of the plurality of minute-diameter short-hair-shaped members made of a conductor such as metal which is tied up into a bundle.

The intermediate connector 14 is abutted directly against and so electrically connected to a grounding part (not shown) of the microphone unit 2. The intermediate connector 14 has a sufficiently large length than a radial dimension of the gap A and is disposed roughly radially outward of the cylindrical housing 4. With this, the tip of the intermediate member 14 comes in contact with the inner peripheral surface of the cylindrical housing 4. The tip of the intermediate connector 14 thus comes in contact with the inner peripheral surface of the cylindrical housing 4, to cause the grounding part of the microphone unit 2 to be electrically connected via the intermediate connector 14 to the cylindrical housing 4 with essentially the shortest distance. Note here that the intermediate connector 14 may be formed toward the microphone unit 2 on the inner peripheral surface of the cylinder housing 4.

On the outer peripheral surface of the cylindrical housing 4 is provided another intermediate connector 15. The intermediate connector 15, like the intermediate connector 14, is comprised of a plurality of elastic short-hair-shaped members with a sufficiently low electrical resistance which is implanted in the peripheral surface of the cylindrical housing 4. Specifically, like the intermediate connector 14, for example, the intermediate connector 15 is provided by tying up the plurality of minute-diameter short-hair-shaped members made of a conductor such as metal into a bundle.

The intermediate connector 15 has a sufficiently larger length than a radial dimension of the gap B and is disposed radially outward of the cylindrical housing 4. This disposition causes the tip of the intermediate connector 15 to come in contact with the inner peripheral surface of the outer cylinder 5. The tip of the intermediate connector 15, thus comes in contact with the inner peripheral surface of the outer cylinder 5, to thereby electrically connect the cylinder housing 4 to the outer cylinder 5 with essentially the shortest distance. Also, the intermediate connectors 15 and 14 are disposed at the same position along the axis of the cylinder housing 4. This disposition causes the grounding part of the microphone 2 unit to be electrically connected to the outer cylinder 5 via the intermediate connector 14, the cylindrical housing 4, and the intermediate connector 15 with essentially the shortest distance.

A grounding part (not shown) of the amplification circuit board 3 is provided on an end surface thereof, which comes in contact with the inner peripheral surface of the cylindrical housing 4 to thereby electrically connect the grounding part of the amplification circuit board 3 to the cylindrical housing 4 with essentially the shortest distance.

The outer cylinder 5 is, as mentioned above, electrically connected via the lid 10 to the shield layer 12*b* of the microphone cable 12 to thereby electrically connect the outer cylinder 5 to the shield layer 12*b* with essentially the shortest distance. Accordingly, the microphone unit 2 and the cylindrical housing 4 are electrically connected through the outer cylinder 5 to the shield layer 12*b* of the microphone cable 12. Moreover, that connection distance is essentially the shortest mostly. It should be noted that the intermediate connector 15 may be disposed on the inner peripheral surface of the outer cylinder 5 toward the cylindrical housing 4.

Figure 3:
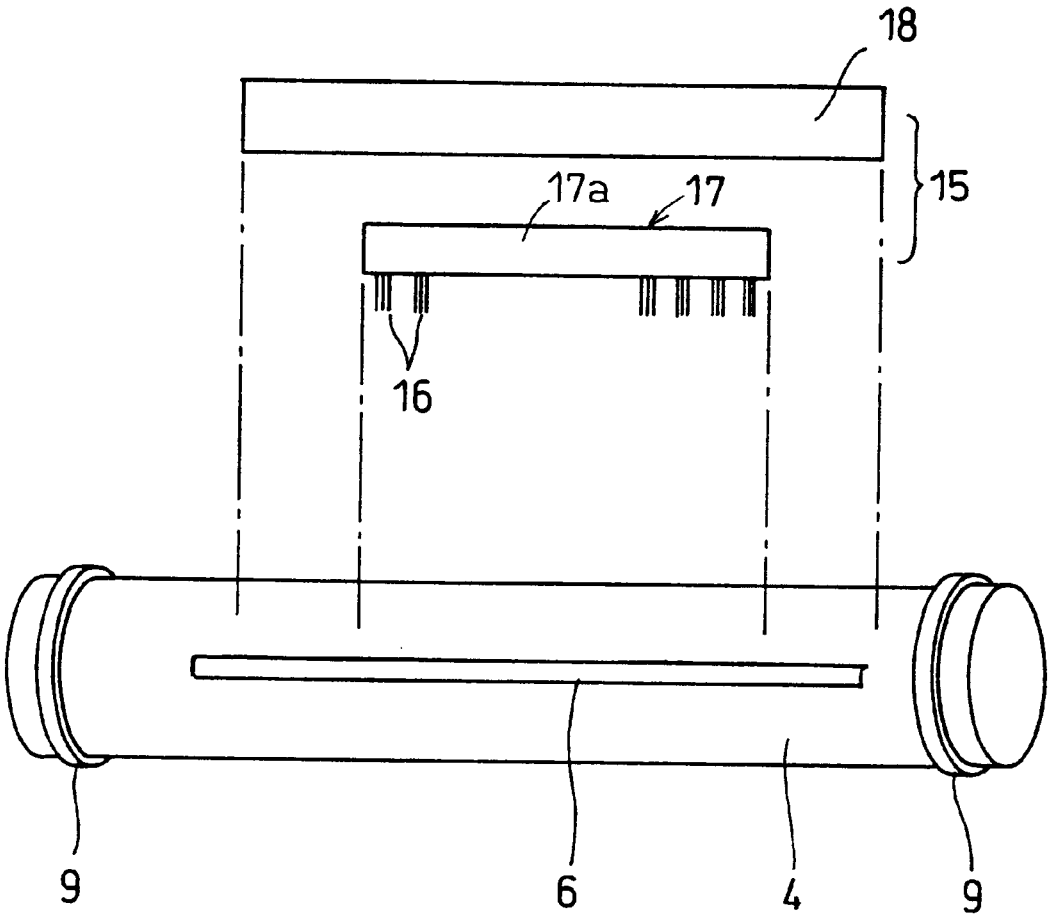
FIG. 3 is a perspective view for showing an example of attachment of an intermediate connector.

The intermediate connectors 14 and 15 can be configured as shown in FIG. 3, for example. That is, a plurality of conductive and elastic short-hair-shaped members 16 (which is made of metal, for example) is tied up with a fixing frame 17*a* into a hair bundle 17. This hair bundle 17 is in turn adhered and fixed with an adhesive tape 18 to the cylindrical housing 4 or the microphone unit 2, thus forming the intermediate connector 14 or 15. Note here that the fixing frame 17*a* or the adhesive tape 18 should be made of a conductor preferably in order to improve electrical connection. Also, although FIG. 3 exemplifies a fixed construction of the intermediate connector 15, the intermediate connector 14 may also be of the ii same construction, of course.

Figure 4:
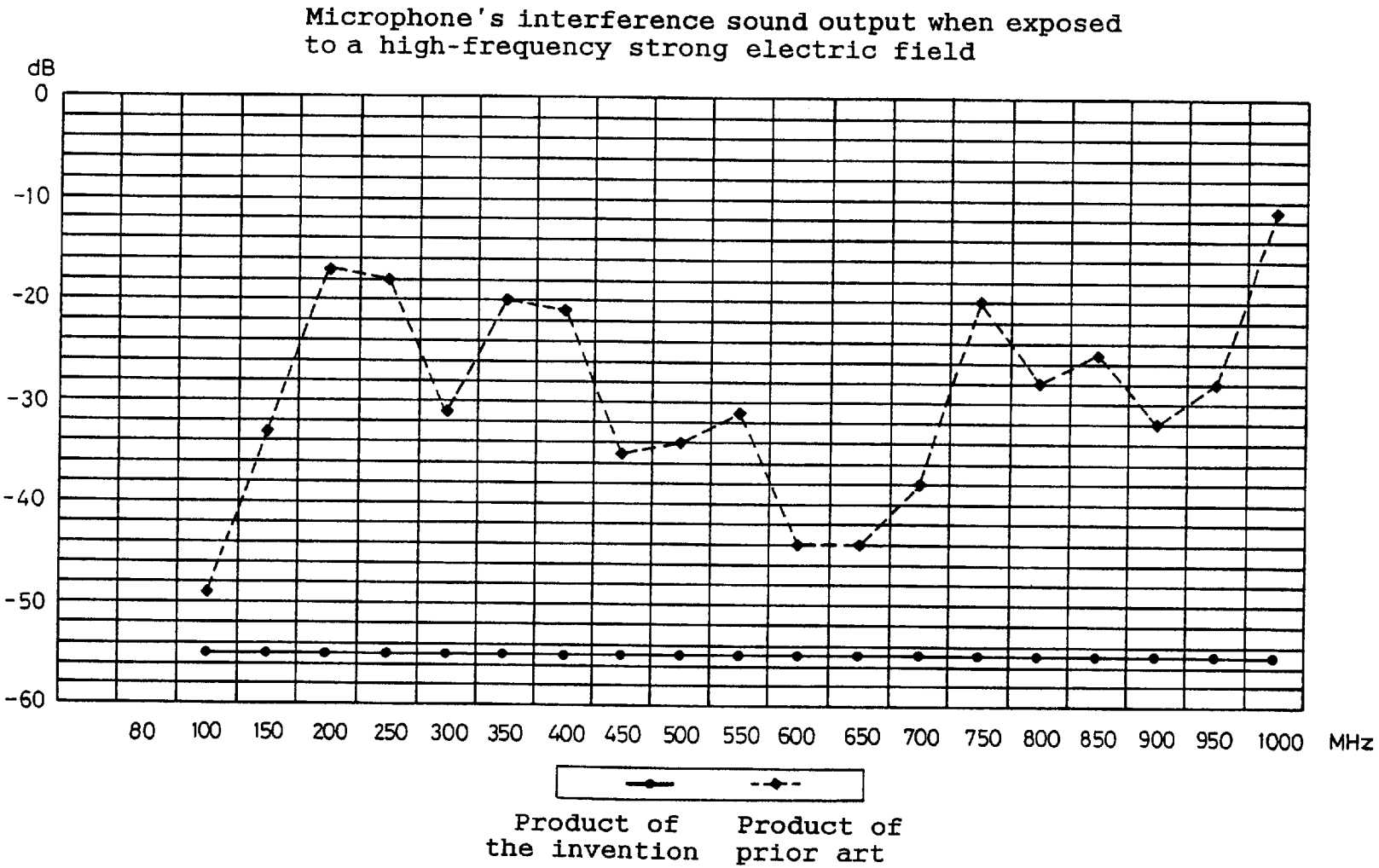
FIG. 4 is a graph for showing an output level characteristic of a leakage modulation sound according to the invention.

The following will describe a result of measuring a leakage output (interference sound output) of a modulated sound when this microphone 1 was disposed in an environment of a strong electric field of a frequency of 100–1000 MHz (30 V/m calculated as electric field strength) and a modulation frequency of 1 kHz/80% along with a measurement result of a prior art microphone with reference to FIG. 4. In FIG. 4, the horizontal axis indicates a frequency (MHz) and a vertical axis, a leakage output (dB).

As may be clear from FIG. 4, the prior art product exhibits a rise in leakage output level of about up to −44 through −10 dB of an SRL (standard recording level) in each frequency band (150–1000 MHz). In contrast, the microphone 1 according to this embodiment of the invention exhibits a mostly stable and very low leakage output level of about −55 dB in every frequency band. This is considered because the invention has provided the intermediate connectors 14 and 15 in its configuration to thereby enable to decrease to the ground potential with essentially the shortest distance a high-frequency signal which occurs on the microphone unit 2, the cylindrical housing 4, and the outer cylinder 5 owing to an influence of a surrounding high electric field. Further, since the grounding part of the amplification circuit board 3 is connected via the cylindrical housing 4 to the ground potential with essentially the shortest distance, a high-frequency signal occurring at the amplification circuit board 3 can also be shirt-circuited to the ground potential efficiently, thus possibly suppressing the leakage output level by that much.

Note here that in this microphone 1, the intermediate connectors 15 and 14 are provided at the same position along the axis of the cylindrical housing 4. This configuration enables to essentially minimize the length of a path from the connecting part of the microphone unit 2 to the ground terminal to thereby reduce the leakage output level to a minimum. At a high electric field of about 1000 MHz, however, the same effect of leakage output level reduction can be given even if the intermediate connector 15 is provided at any axial position of the cylindrical housing 4.

Also, the gap B between the cylindrical housing 4 and the outer cylinder 5 encounters cavity resonance in a frequency band of a few tens of mega-hertz to a few giga-hertz according to a frequency of an electric field which occurs at the gap. The axial position of a region subject to such cavity resonance is determined by such a frequency. Therefore, by disposing the intermediate connector 15 at such a position subject to cavity resonance, the high-frequency signal occurring due to the cavity resonance can be decreased to the ground potential efficiently. Further, the intermediate connector 15 can be uniformly disposed at every axial position of the cylindrical housing 4. Then, high-frequency signals occurring corresponding to various frequencies owing to cavity resonance at any axial positions can be decreased to the ground potential efficiently. Moreover, the cylindrical housing 4 can also be connected to the ground potential with essentially the shortest distance.

Figure 5:
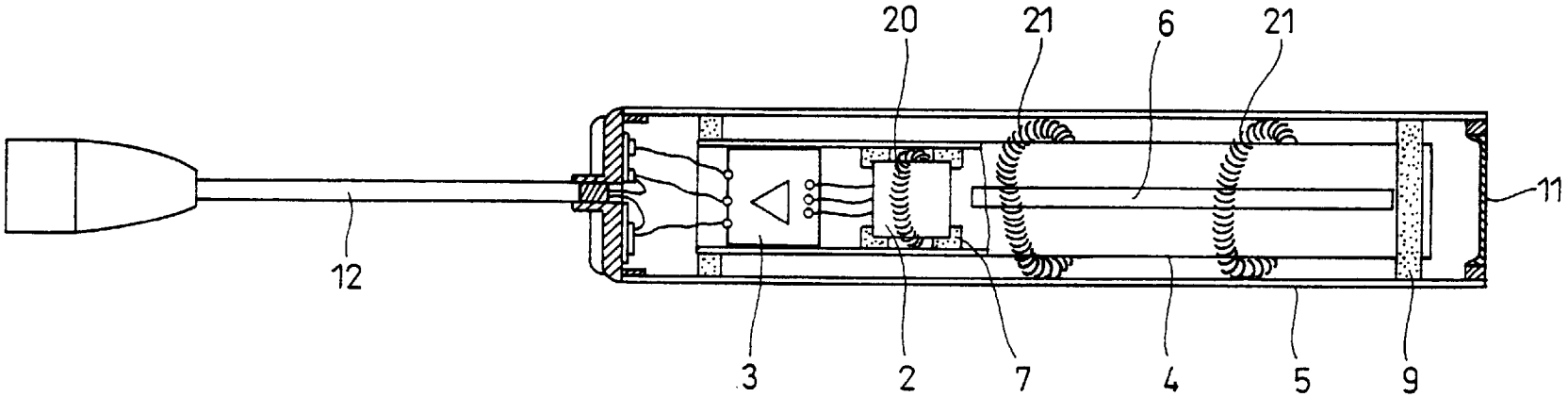
FIG. 5 is a cross-sectional view for showing a variant of the invention.

Besides the intermediate connectors 14 and 15 made of such a short-hair-shaped member as shown in FIG. 2, such intermediate connectors 20 and 21 may be used as made of a twist-reformed elongated conductor slice (e.g., metal slice) As shown in FIG. 5. Such intermediate connectors 20 and 21 can also be electrically connected while blocking the mechanical vibrations. The microphone shown in FIG. 5 is basically of the same construction as the microphone 1 shown in FIG. 2, so that the same or similar elements are indicated by the same reference numerals and omitted in explanation.

Here, the twist-reformed elongated conductor slice refers to the following, for example. That is, a conductor such as metal is cut into a slice, which is in turn twist-reformed into an elastic cylindrical spiral having a small diameter as a whole.

Figure 6:
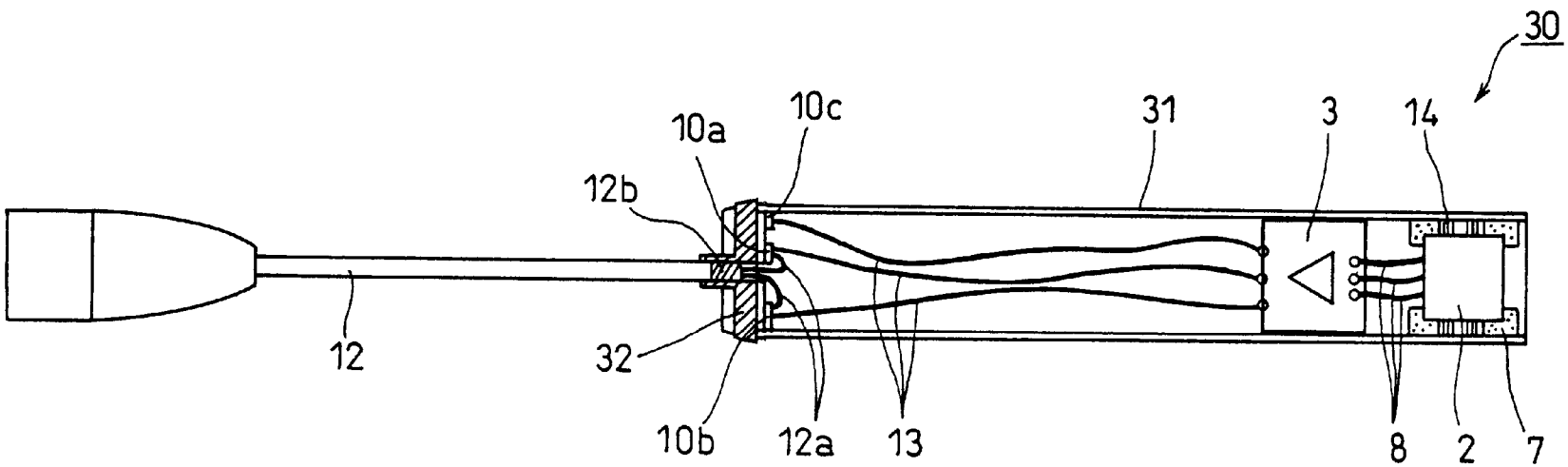
FIG. 6 is a cross-sectional view for showing another variant of the invention.

In the above embodiment, although the invention has been applied to the directional microphone 1 having the cylindrical housing 4 and the outer cylinder 5, the invention is applicable also to a non-directional microphone 30 which has only a cylindrical housing 31 but does not have an outer cylinder shown in FIG. 6. Note here that FIG. 6 shows basically the same configuration of the directional microphone 1 of FIG. 2 except that there is no outer cylinder provided nor another intermediate member between the outer cylinder and the cylindrical housing and also somewhat except for the configuration of the cylindrical housing 31, so that the same or similar elements are indicated by the same reference numerals and omitted in explanation. A lid 32, however, is electrically connected to the shield layer 12*b* of the microphone cable 12 and the cylindrical housing 31.

Figure 7:
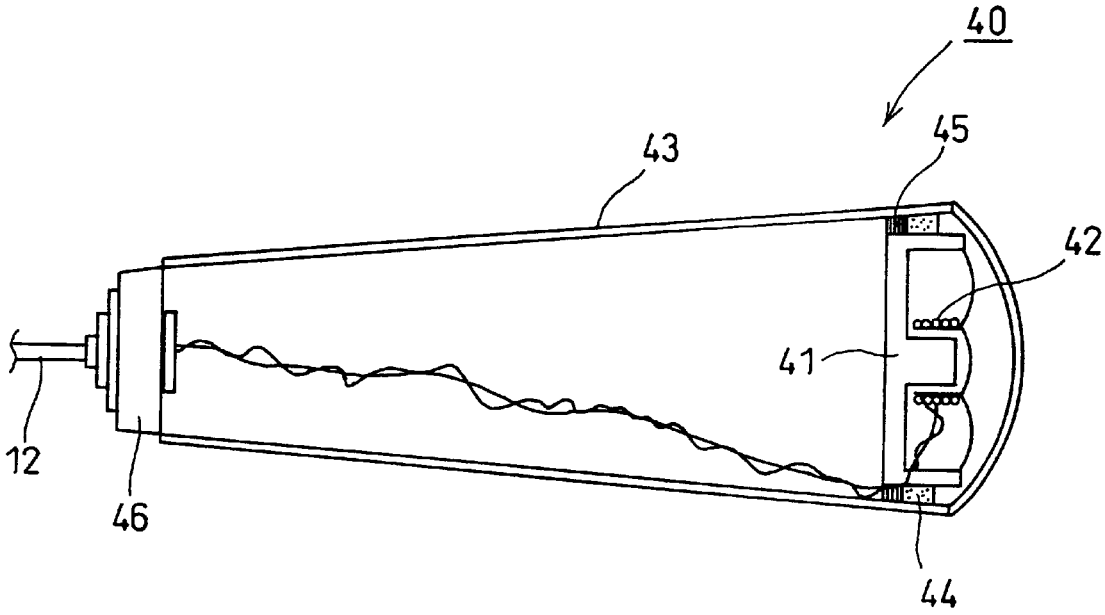
FIG. 7 is a cross-sectional view for showing a further variant of the invention.

The invention is applicable also to a dynamic microphone 40 shown in FIG. 7. That is, in this dynamic microphone 40, a permanent magnet core 41 and a movable coil 42 are housed and disposed in a cylindrical housing 43 made of a conductor with vibration preventing rubber 44 therebetween. Between the cylindrical housing 43 and the permanent magnet core 41 is provided an intermediate connector 45 similar to the above-mentioned intermediate connectors 14, 15, 20, and 21. Further, although not shown, a lid 46 has almost the same configuration as the above-mentioned lid 32.

Although the above-mentioned embodiment has used a short-hair-shaped member or a twist-reformed elongated conductor slice to make up the intermediate connectors 14, 15, 20, 21, and 45, the vibration preventing rubber 7, 9, and 44 may be provided with conductivity (by mixing conductive particles into the rubber, for example) to thereby serve as the intermediate connector.

Industrial Applicability

According to the invention, it is possible to securely inhibit an interference sound caused by a high electric field occurring at a portable telephone etc., thus realizing a microphone which is not liable to be influenced by the electromagnetic wave.

Also, the invention has proved to be able to provide a microphone having an electromagnetic-wave resistance good enough to accommodate the laws and regulations which are expected to become ever increasingly severer in many counties in order to prevent beforehand the disturbance due to malfunctioning of the electronic equipment owing to an influence of an electromagnetic wave.

What is claimed is:

1. A microphone comprising:

a microphone unit;

a cylindrical housing made of a conductor for housing said microphone unit; and an intermediate connector for electrically connecting a grounding part of said microphone unit to said sylinddrical housing with essentially the shortest distance while blocking mechanical vibrations, wherein said intermediate connector is made of an elastic short-hair-shaped conducting member, which is protruded from either one of said microphone unit and said cylindrical housing with a tip thereof as abutted against the other.

2. The microphone according to claim 1, further comprising a supporting member for supporting said microphone unit in said cylindrical housing while blocking mechanical vibrations.

3. The microphone according to claim 1, wherein an amplification circuit board for amplifying an output signal of said microphone unit is housed in said cylindrical housing and has a grounding part thereof electrically connected to said cylindrical housing with essentially the shortest distance.

4. The microphone according to claim 1, further comprising:

a lid made of a conductor for sealing an end of said cylindrical housing as electrically connected thereto; and a microphone cable disposed so as to pass through said lid from an inside to an outside of said cylindrical housing, thus leading an output signal of said microphone to an outside, wherein a shield layer of said microphone cable and said lid are interconnected electrically.

5. The microphone according to claim 1, further comprising:

an outer cylinder made of a conductor for surrounding a peripheral surface of said cylindrical housing; and another intermediate connector for electrically connecting said cylindrical housing to said outer cylinder with essentially the shortest distance while blocking mechanical vibrations.

6. A microphone comprising:

a microphone unit;

a cylindrical housing made of a conductor for housing said microphone unit; and an intermediate connector for electrically connecting a grounding part of said microphone unit to said cylindrical housing with essentially the shortest distance while blocking mechanical vibrations, wherein said intermediate connector is made of a twist-reformed elongated conductor slice.

7. The microphone according to claim 6, further comprising a supporting member for supporting said microphone unit in said cylindrical housing while blocking mechanical vibrations.

8. The microphone according to claim 6, wherein an amplification circuit board for amplifying an output signal of said microphone unit is housed in said cylindrical housing and has a grounding part thereof electrically connected to said cylindrical housing with essentially the shortest distance.

9. The microphone according to claim 6, further comprising:

a lid made of a conductor for sealing an edge of said cylindrical housing as electrically connected thereto; and a microphone cable disposed so as to pass through said lid from an inside to an outside of said cylindrical housing to thereby lead an output signal of said microphone to the outside, wherein a shield layer of said microphone cable is electrically connected to said lid.

10. The microphone according to claim 6, further comprising:

an outer cylinder made of a conductor for surrounding a peripheral surface of said cylindrical housing; and another intermediate connector for electrically connecting said cylindrical housing to said outer cylinder with essentially the shortest distance while blocking mechanical vibrations.

11. A microphone comprising:

a microphone unit;

a cylindrical housing made of a conductor for housing said microphone unit;

an intermediate connector for electrically connecting a grounding part of said microphone unit to said cylindrical housing with essentially the shortest distance while blocking mechanical vibrations;

an outer cylinder made of a conductor for surrounding a peripheral surface of said cylindrical housing; and another intermediate connector for electrically connecting said cylindrical housing to said outer cylinder with essentially the shortest distance while blocking mechanical vibrations, wherein said another intermediate connector is made of an elastic short-hair-shaped conducting member, which is protruded from either one of said cylindrical housing and said outer cylinder with a tip thereof as abutted against the other.

12. The microphone according to claim 11, wherein said intermediate connector and said another intermediate connector are disposed at the same position in an axial direction of the cylindrical housing.

13. The microphone according to claim 11, wherein said another intermediate connector is disposed at a position where a possibility of cavity resonance occurring in the microphone is high.

14. A microphone comprising:

a microphone unit;

a cylindrical housing made of a conductor for housing said microphone unit;

an intermediate connector for electrically connecting a grounding part of said microphone unit to said cylindrical housing with essentially the shortest distance while blocking mechanical vibrations;

an outer cylinder made of a conductor for surrounding a peripheral surface of said cylindrical housing; and another intermediate connector for electrically connecting said cylindrical housing to said outer cylinder with essentially the shortest distance while blocking mechanical vibrations, wherein said another intermediate connector is made of a twist-reformed elongated conductor slice.

15. The microphone according to claim 14, wherein said intermediate connector and said another intermediate connector are disposed at the same position in an axial direction of the cylindrical housing.

16. The microphone according to claim 14, wherein said another intermediate connector is disposed at a position where a possibility of cavity resonance occurring in the microphone is high.

* * * * *